US011199174B2

(12) United States Patent
Chamberlain

(10) Patent No.: US 11,199,174 B2
(45) Date of Patent: Dec. 14, 2021

(54) GENERATOR

(71) Applicant: Luke Chamberlain, Ringwood (GB)

(72) Inventor: Luke Chamberlain, Ringwood (GB)

( * ) Notice: Subject to any disclaimer, the term of this patent is extended or adjusted under 35 U.S.C. 154(b) by 570 days.

(21) Appl. No.: 15/779,636

(22) PCT Filed: Nov. 25, 2016

(86) PCT No.: PCT/GB2016/053701
§ 371 (c)(1),
(2) Date: May 29, 2018

(87) PCT Pub. No.: WO2017/089814
PCT Pub. Date: Jun. 1, 2017

(65) Prior Publication Data

US 2021/0017952 A1 Jan. 21, 2021

(30) Foreign Application Priority Data

Nov. 27, 2015 (GB) ..... 1520998

(51) Int. Cl.
*F03B 17/02* (2006.01)
*F03B 17/00* (2006.01)

(52) U.S. Cl.
CPC ..... *F03B 17/02* (2013.01); *F03B 17/005* (2013.01)

(58) Field of Classification Search
CPC ..... F03B 17/02; F03B 17/005; F03B 13/10
See application file for complete search history.

(56) References Cited

U.S. PATENT DOCUMENTS

| | | | | |
|---|---|---|---|---|
| 4,211,077 | A | 7/1980 | Cassidy | |
| 8,456,031 | B1 | 6/2013 | Hull | |
| 8,575,775 | B1 * | 11/2013 | Gonzalez-Carlo | F03B 17/061 290/54 |
| 2003/0059292 | A1 | 3/2003 | Baker | |
| 2009/0140523 | A1 | 6/2009 | Deangeles | |
| 2009/0140525 | A1 | 6/2009 | Deangeles | |

FOREIGN PATENT DOCUMENTS

| | | | | |
|---|---|---|---|---|
| GB | 2428071 | | 1/2007 | |
| GB | 2428071 | A * | 1/2007 | F03B 17/04 |
| GB | 2522085 | | 5/2014 | |
| WO | WO2012039629 | | 3/2012 | |
| WO | WO2012051678 | | 4/2012 | |
| WO | WO2008145971 | | 12/2018 | |

* cited by examiner

*Primary Examiner* — Viet P Nguyen
(74) *Attorney, Agent, or Firm* — Royal W. Craig; Gordon Feinblatt LLC

(57) ABSTRACT

A hydro-turbine apparatus (1) comprising a turbine (9), a water collection chamber (11), a water inlet, at least one water injector (10) directed towards the turbine so as to provide a driving force to the turbine, wherein the water inlet in communication with the at least one water injector, and the water collection chamber arranged to receive water which has been directed at the turbine, and the apparatus arranged for operative submersion in a body of water (WL).

15 Claims, 1 Drawing Sheet

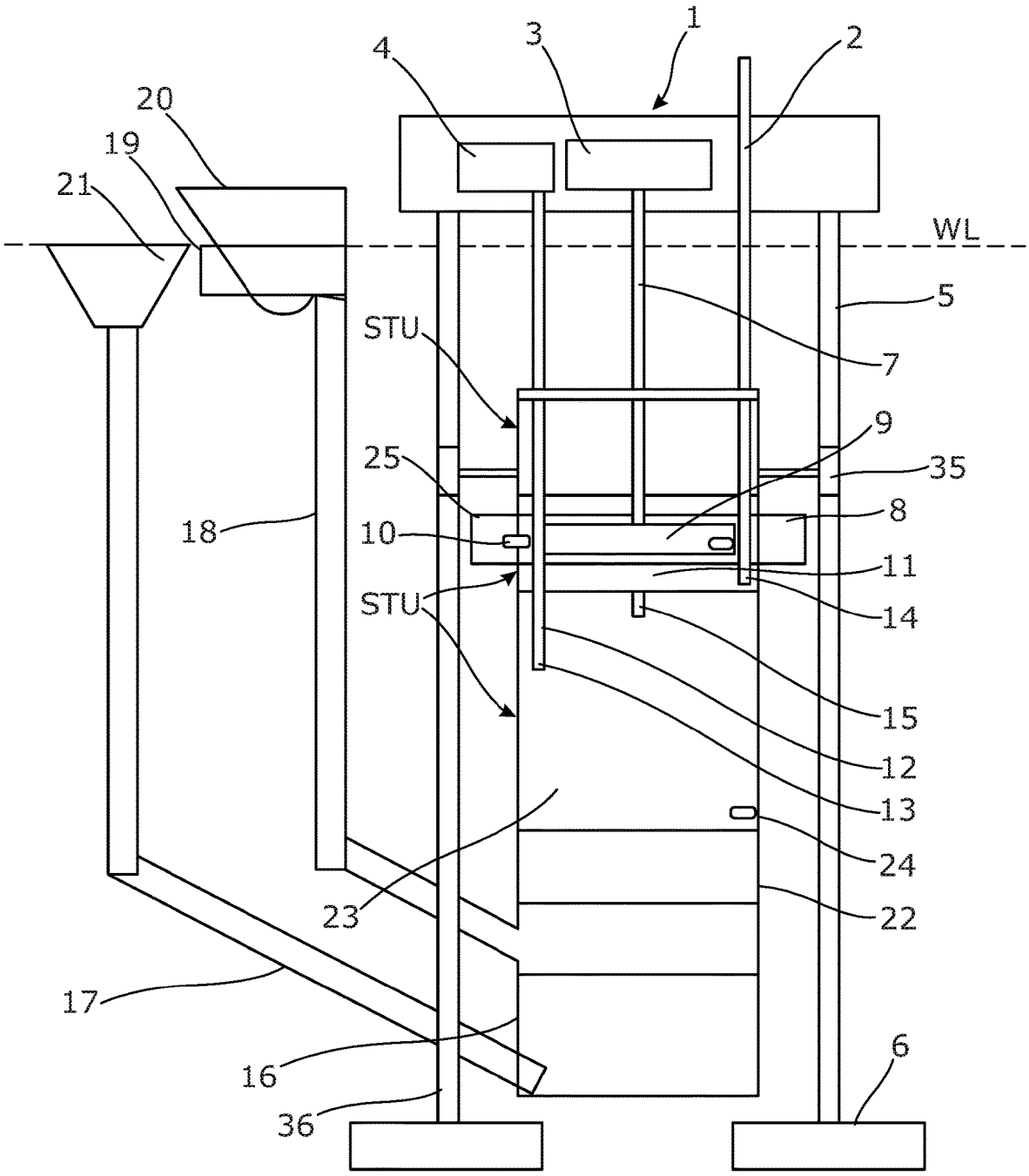
1
2
3
4
20
19
21
WL
5
7
STU
9
25
35
8
18
10
11
STU
14
15
12
13
24
23
22
17
16
6
36

GENERATOR

TECHNICAL FIELD

The present invention relates generally to generators.

BACKGROUND

With the ongoing requirement for energy generation which is both clean and efficient, we have devised a novel hydro-turbine generator apparatus.

SUMMARY

According to the invention there is provided a hydro-turbine apparatus comprising a turbine, a water collection chamber, a water inlet, at least one water injector directed towards the turbine so as to provide a driving force to the turbine, wherein the water inlet in communication with the at least one water injector, and the water collection chamber arranged to receive water which has been directed at the turbine, and the apparatus arranged for operative submersion in a body of water.

The apparatus preferably comprising an emptying arrangement to urge water out from the water collection chamber.

The water inlet is preferably arranged to be submerged so as to allow a head of water to urge water towards the at least one water injector.

The at least one water injector preferably comprises a plurality of apertures or ports which in use focus jets of (high pressure) water towards the turbine (so as to provide a motive force on the turbine).

An intermediate water collection space may be provided between a water outlet of the turbine and an inlet to the water collection space, and an outlet from the intermediate water collection chamber being provided to the water collection chamber. Preferably the outlet comprises at least one isolation or non-return valve to prevent fluid flowing from the water collection chamber to the intermediate water collection space. Preferably, the intermediate water collection space is vented to the atmosphere.

The turbine, water collection chamber, water inlet, preferably at least one water injector and water collection chamber are provided as a unit which is moveable vertically by way of connections to upright rails of a supporting framework. The vertical position of the unit may be controllable by way of buoyancy device.

The apparatus may be viewed as (sealed) turbine assembly arranged to create a pressured differential between an internal space and a body of water in which the apparatus is submerged, and the assembly arranged to be lowered and/or raised therein which can be used to control the operational pressure of the turbine as well as the pressure to empty the internal space.

The turbine may be connected to a generator by way of a drive shaft, wherein the generator is provided in or on a support structure arranged to be maintained above water.

The apparatus may comprise a compressed gas supply, such as compressed air, and the gas supply arranged to force water out from the water collection chamber.

The gas supply may be arranged to expel water in the water collection chamber into the surrounding water.

An aspect of operation of the apparatus may comprise sequentially opening and closing the water containment chamber.

The hydro-turbine assembly may comprise a buoyancy transfer apparatus arranged to provide buoyant material to the unit so as to assist lifting of the unit towards the waterline. The buoyancy transfer apparatus may also be operative to remove the buoyant material away from providing a buoyant effect to the unit. The buoyancy transfer unit may comprise a chamber (attached to the unit) which can be selectively filled and expelled of buoyant material.

The apparatus is at least in part sealed from the surrounding body of water.

The apparatus may be viewed as comprising a sealed unit which houses the turbine.

The apparatus may comprise any features either individually or in combination, described in the description and/or shown in the drawings.

BRIEF DESCRIPTION OF THE DRAWINGS

Various embodiments of the invention will now be described, by way of example only, with reference of FIG. 1, which shows a schematic front elevation of a hydro generator.

DETAILED DESCRIPTION

In overview, the hydro generator Station 1, which is described in more detail below, comprises a Sealed Hydro Turbine Unit (STU), which produces electricity by way of water pressure turning a hydro turbine 9. The STU is located within a volume of water at a depth required that causes the water pressure via the water injectors 10 located in the STU to inject water at the turbine impeller at high pressure. The STU is air tight/sealed from the external water volume of the water body. As the STU is lowered into the water volume the external water pressure increases thereby creating a positive/negative pressure differential within the STU. The full energy of the entering water is captured by the hydro turbine as the STU descends deeper into the water, and as the water head pressure is increased and the hydro turbine is caused to spin faster. The STU is mounted to be vertically moveable on upright legs 36 by way of mountings 35, which upright legs are part of an overall rig assembly 5.

The pressure of the water entering the STU (initially at open-ended water inlet 8) causes air pressure to build within the STU, and so there is provided a ventilation system controlled by isolation and check valves, to allow air in/out of the STU as required. During operation, if excess air pressure builds, open isolation valves can be held open to allow the air to vent to atmosphere, by controlling the amount of air released. The speed of the turbine can also be controlled by reducing the differential pressure within the STU to the external water pressure.

As the water enters the STU via the water injectors to turn the turbine impellers, a STU catchment area 11 progressively fills with water, by injecting the water at the turbine the volume of water required to turn the turbine is reduced, however the STU catchment area 11 must be empted for the process to continue, and so a separate ballast tank 23 is provided below the STU to accept this water from the STU catchment area 11. Isolation valves are provided between the catchment area 11 and the ballast tank 23 and an isolation valve controls on the air supply/vent pipes. This enables the ballast tank to be isolated from the STU catchment area when the ballast tank is being emptied by high pressure air/gas from a compressor circuit which is connected to the ballast tank.

During operation, the STU fills the catchment area with water, the isolation valves to the ballast tank remain closed until the pressure within the ballast tank and catchment are equal. The reason for this is that later in the process the ballast tank is emptied at a higher pressure than external water pressure causing the water to be purged from the ballast tank to the external water volume via check valves. The check valves enable this pressure to be recaptured via the compressed air circuit during the operation of the STU. The STU moves up the rig 5 aided via buoyance material the external water pressure decreases, thereby forcing the higher pressure compressed air (that was used previously to purge the ballast tank) within the ballast tank to head back up to the compressed air circuit into an expansion vessel for storage to be reused. This compressed air circuit is controlled by isolation control valves and check valves and excessive pressures can be vented to atmosphere. Once pressures are equal, the isolation valves are then opened and the stored water within the catchment area travels down into the ballast tank. This enables the STU to continue operation, the process repeats and the compressor circuit adds/increases compressed air as required, the pressure is controlled within the STU and within all vent/air supply pipework by isolation/control valves to maintain the correct operation by increasing/decreasing pressures within the STU.

To assist the STU travelling back upwardly of the rig 5 to a lower external pressure and thereby reducing the amount of energy required to empty the ballast tanks as above, a hopper is installed at water level that contains buoyancy aid material is connected via pipework 17 to the lifting chamber 22 installed on the STU.

The STU reaches a lower door 16 lifting chamber when the ballast tank is full, the buoyancy aid hopper feeds the buoyancy aid material to the lifting chamber via pipework connected to the STU, as the lifting chamber 22 fills, the STU rises to the ballast venting point at which time the ballast tank is blown (through introduction of compressed air) causing the water within the tank to be expelled to the external water volume. Once the tank is empty and due to the air within the ballast tank the STU continue to rise reaching the higher door lifting chamber which allows the buoyancy aid to travel back to the hopper catchment area via pipework so the buoyancy aid can be reused via a hopper scoop. The process begins again and continues accordingly.

In order to facilitate raising and emptying of the ballast tank 23, a mechanism (not illustrated) may be provided to open the contents of the tank to the surrounding water, and thereby equalise the pressure of the water in the tank and the surrounding body of water. This serves to facilitate the filling process. The ballast tank would be opened at the lowest depth, when full. Overall, this should result in less work required to lift and empty the tank.

The STU is shown fitted to a rig type assembly which enables, for industrial-scale applications, to be installed and lowered into deep water. The turbine drive shaft 7 extends from the water and connects to a generator 3 to produce electricity. The rig also allows the STU to be lifted above the water level for maintenance and servicing. Increasing the depth of the STU increases the water pressure and thereby increases the speed and operational efficiency of the turbine of the STU.

Advantageously, the hydro-turbine has numerous industrial applications. The STU could be installed within a rig type assembly (as exemplified above) for large power plant applications, with the rig assembly located, for example, on the sea/lake/river/bore hole/well or designed into a power plant environment to enable the STU to be submerged within a contained volume of water.

The hydro-turbine also has various light industrial/domestic applications by way of use in bore holes, wells, lakes, rivers the unit is fitted into location; the compressor and generator are sealed within a unit above water level, located away from the STU.

Additionally the hydro-turbine could also be used as a personal energy generating device. A compact version can be envisaged for personal use (for example for camping) to provide a convenient small power requirement. The device can be inserted into any container that provides head pressure that allows the turbine to spin to produce power. The ballast tank would be emptied manually once full. The design enables a number of sizes from hand-held to suit carry-case size for different power requirements.

A summary of the features shown in FIG. 1 is given below.

1: Generator Station, above water line (WL).

2: Air Supply/Vent Pipe system, allowing the Sealed Turbine Unit (STU) to vent to atmosphere or breathe, as the STU fills or expels water via the ballast tank controlled by isolation valves.

3: Generator

4: Compressor and expansion vessel. The compressor provides compressed air to pressurise the ballast tank when required to be emptied, and the expansion vessel is used to recapture the high pressure air from the STU.

5: Optional Rig Assembly with support legs, which enables the STU to be lifted/lowered or retained in position to enable the turbine to be held at the optimum level for required speed of turbine efficiency. Raising the STU reduces the pressure within the STU allowing a lesser compressed air/gas required to 'blow' the ballast tank.

6: Weighted support pads, to secure the rig assembly in position, the rig can also be fixed to a foundation on larger installations.

7: Telescopic turbine drive shaft connected from the turbine to the generator, the shaft can be configured to allow adjustment to the required depth.

8: STU water catchment collection chamber which filters water before entering the STU via the water injectors.

9: Hydro turbine.

10: Water Injectors, which direct the high pressure water to turn the turbine blades, the injectors are used to intensify the water pressure directed at the turbine blades and reduce the amount of water required to spin the turbine, the water used falls to the bottom of the turbine chamber of the STU, which is isolated from the ballast tank via valves once the ballast tank is ready to receive this water.

11: STU, incorporating the water injectors, as the water enters at high pressure the air within the STU is forced out of the vent pipe system allowing the water to enter the STU without disruption to the STU from air restriction/starvation. The water in the catchment area 8 feeds to the injectors 10.

12: Supply/Vent pipe of compressed air or gas to blow ballast tank as required, which is connected to the ballast tank and expansion vessel, the air/gas used in the STU is recycled and held within the expansion tank/vessel 4.

13: Control Valve, operates to allow high pressure air/gas into ballast tank, when required using the differential pressure to empty ballast.

14: Control Valve, to control air entering/exiting the turbine chamber controlling the speed of water entering the STU and thereby the speed of turbine.

15: Control valve to seal ballast tank during venting process which isolates the ballast tank from STU turbine chamber during the emptying process of the ballast tank with high pressure, this enables turbine to continue operation during emptying process.

16: The STU moves within the Hopper high/low door lifting chamber, as the STU gravitates down and reaches the lower door opening position connected to hopper inlet pipe, buoyancy materials (BM) enters and aid the raising of the STU, as the lifting chamber of the STU fills via the hopper unit of BM, this aides the rise of the STU to the ballast vent point, once reached the lower door opening position is passed preventing any further BM entering the chamber and the ballast tank is blown, as the STU rises higher it reaches the higher door opening position which allows the BM to exit and return back to the BM catchment area at water level so to be re-used.

17: Flexible supply pipe from the hopper enables the BM to travel pumped under the water into the lower door chamber unit.

18: Flexible return pipe from the higher door chamber unit allows the BM to return to the catchment area of the hopper unit.

19: Collection chamber to accept BM from higher door chamber unit.

20: Hopper scoop, collects the BM from the collection chamber, directs BM into the hopper as required.

21: Hopper, BM is placed within hopper and water is pump or gravitated with the BM to force it down pipe work into lifting chamber unit.

22: Lifting chamber.

23: Ballast Tank.

24: Check/Isolation Pressure valve, since there is pressure in ballast tank excess external water pressure the ballast tank empties, once empty the valve closes to prevent external water re-entering the ballast tank, during operation phase of recovering the compressed gas/air.

25: Is a filter, suitable to prevent ingress of contaminants or unwanted matter carried in water entering the STU. It will be appreciated that the location of the filter as shown is purely schematic, and that filter, or filters, could be located at a common inlet to the STU and/or in each injector. One or more pipes or conduits may be provided, connected to the or an inlet, which provide a supply of pressurised water to the or each nozzle.

In an alternative embodiment, more than one ballast tank may be provided such that when a first ballast tank becomes full, an output from the catchment area can be switched (for example, by way of an electro-mechanic device) to an empty ballast tank. This allows for continuous power generation, without interruption due to emptying of a full ballast tank. Whilst a second ballast tank is being filled the full ballast tank can be emptied. Ballast tanks may be provided fixed to the floor of the body of water, such as resting on the sea bed or ocean floor.

It will be appreciated that a further embodiment, or modified versions of either of the above embodiments, the turbine unit and ballast tank may be static, and need not necessarily drop down as the ballast tanks fills, and then raised to empty the same.

It will further be appreciated that the or each ballast tank may be rigid or flexible, and may comprise a bag structure.

Although mention above has been made to emptying the ballast tank(s) through a supply of compressed air or compressed gas, this may alternatively be achieved, for example by way of a steam generator.

The invention claimed is:

1. A hydro-turbine apparatus, comprising:

a turbine; and a modular turbine unit configured to inject water at the turbine, said modular turbine unit further comprising, a water inlet, a water collection chamber, at least one water injector directed towards the turbine and configured to provide a driving force to the turbine, wherein the water inlet is in communication with at least one water injector, the modular turbine unit being arranged for vertical movement and operative submersion in a body of water;

a supporting framework configured for guiding movement of said modular turbine unit vertically.

2. A hydro-turbine apparatus as claimed in claim 1 in which the water inlet is configured to be submerged so as to allow a head of water to urge water towards the at least one water injector.

3. A hydro-turbine apparatus as claimed in claim 1 in which the at least one water injector apparatus comprises a plurality of apertures which focus jets of high pressure water towards the turbine so as to provide a motive force on the turbine.

4. A hydro-turbine apparatus as claimed in claim 1 further comprising a ballast tank below the modular turbine unit for receiving water from the water collection chamber, an outlet from the water collection chamber being provided to the water collection chamber.

5. A hydro-turbine apparatus as claimed in claim 4 in which the outlet comprises an isolation valve to prevent fluid flowing from the water-collection chamber to the ballast tank.

6. A hydro-turbine apparatus as claimed in claim 4 in which the ballast tank is vented to the atmosphere.

7. A hydro-turbine apparatus as claimed in claim 1 in which the supporting framework comprises guide rails.

8. A hydro-turbine apparatus as claimed in claim 1 in which a vertical position said modular turbine unit is controllable by way of a buoyancy device.

9. A hydro-turbine apparatus as claimed in claim 1 in which the turbine is connected to a generator by way of a rotatable shaft, wherein the generator is provided in or on a support structure arranged to be maintained above water.

10. A hydro-turbine apparatus as claimed in claim 1 which comprises a gas supply configured to force collected water out from the ballast tank.

11. A hydro-turbine apparatus as claimed in claim 10 in which the gas supply is arranged to expel water in the ballast tank into the surrounding body of water.

12. A hydro-turbine apparatus as claimed in claim 1 in which the assembly comprises a buoyancy transfer apparatus arranged to provide buoyant material to the said modular turbine unit to assist lifting towards the waterline.

13. A hydro-turbine apparatus as claimed in claim 12 in which the buoyancy transfer apparatus is also operative to remove the buoyant material away from the modular turbine unit providing a buoyant effect to the modular turbine unit.

14. A hydro-turbine apparatus as claimed in claim 13 in which the buoyancy transfer unit comprises a chamber configured to be be selectively filled and expelled of buoyant material.

15. A hydro-turbine apparatus as claimed in claim 1 which comprises an emptying arrangement to urge water out from the water collection chamber.

* * * * *